United States Patent [19]

Schwartz et al.

[11] 4,373,507

[45] Feb. 15, 1983

[54] STOVE CONSTRUCTION

[75] Inventors: Larry A. Schwartz, Warwick; Robert Geiter, Coventry; Peter S. Albertsen, Quidnesset, all of R.I.

[73] Assignee: Jamestown Group, Providence, R.I.

[21] Appl. No.: 195,399

[22] Filed: Oct. 9, 1980

[51] Int. Cl.[3] ..... F23V 15/00; F23L 11/00

[52] U.S. Cl. ..... 126/289; 126/285 A; 126/299 F; 110/203; 422/177

[58] Field of Search ..... 126/285 A, 75, 77, 289, 126/292, 287, 197, 290; 422/174, 177, 200; 110/203, 210, 214

[56] References Cited

U.S. PATENT DOCUMENTS

| | | | |
|---|---|---|---|
| 230,889 | 8/1880 | Norcross | 126/285 A |
| 1,589,909 | 6/1926 | Tscherning | 126/292 |
| 2,174,347 | 9/1939 | Card | 126/287 |
| 2,443,910 | 6/1948 | Higley | 126/287 |
| 3,090,677 | 5/1963 | Schietlin et al. | 422/174 |
| 4,054,418 | 10/1977 | Miller et al. | 110/203 |
| 4,192,285 | 3/1980 | Nietudski | 126/75 |
| 4,201,186 | 5/1980 | Paquin | 126/285 A |
| 4,207,860 | 6/1980 | Schrock | 126/77 |
| 4,249,509 | 2/1981 | Syme | 126/77 |
| 4,330,503 | 5/1982 | Allaire et al. | 422/177 |

*Primary Examiner*—Samuel Scott
*Assistant Examiner*—Lee E. Barrett
*Attorney, Agent, or Firm*—Salter & Michaelson

[57] ABSTRACT

A wood burning stove having a catalytic converter for achieving greatly increased combustion efficiency, said stove having damper means for insuring that all combustion gases from the primary combustion chamber pass through said converter before reaching the stove's exhaust duct when the damper is in one position, and manual control means for moving the damper to a second position wherein the combustion gases bypass said converter and pass directly to said exhaust duct, it being necessary to move said damper to its second position before the door of said stove can be opened. Said damper has a controlled leakage factor whereby if the converter becomes clogged when the damper is in its first position, combustion gases will be permitted to pass to said exhaust duct. In one operational mode, the stove may be used to burn coal.

8 Claims, 9 Drawing Figures

STOVE CONSTRUCTION

BACKGROUND AND SUMMARY OF THE INVENTION

The present invention relates to wood burning stoves of the airtight variety, although in one operational mode of the invention, the stove can be used to burn coal.

In recent years, due primarily to the energy crisis, wood burning stoves have enjoyed an ever-increasing popularity and public acceptance. The ultimate objective in stoves of this type is to achieve as complete combustion as possible of the combustion gases, since with more efficient combustion, burn time can be increased because it is possible to slow the fire down and still obtain the desired heat transfer for maximum comfort. However, most existing stoves of this type, i.e. airtight wood burning stoves, have a combustion efficiency somewhere in the range of fifty to sixty percent, primarily due to the fact that the ignition point of combustion gases is in the general range of 1300° F. whereas the temperatures generated in stoves of this type are usually in the range of 500° and 900° F. Thus, efficient combustion of these combustion gases has been difficult, if not impossible, to achieve, resulting in lower combustion efficiency, which in turn results in creosote build-up in the chimney or flue, which build-up frequently results in chimney fires. Also, reduced combustion efficiency results in undesirable smoke pollution.

In co-pending U.S. application Ser. No. 136,687, filed Apr. 2, 1980 by Peter S. Albertsen, one of the co-inventors of this application, the concept of using a catalytic converter in stoves of this type of obtain greatly increased combustion efficiency is disclosed. Specifically, by causing the combustion gases to flow through a catalytic converter before reaching the exhaust duct or flue of the stove, the ignition point of the escaping combustion gases is lowered to the general range of 500° F., thus resulting in almost complete afterburn of these gases in the normal range of operating temperatures in stoves of this type. This results in combustion efficiency in the general range of ninety percent, or in other words, an efficiency of approximately thirty-five percent more than that achieved by traditional airtight woodburning stoves. This increased efficiency means little or no pollution will enter the atmosphere because the smoke, a normal by-product of conventional wood stoves, is virtually eliminated, leaving a harmless humid vapor in its place. In addition, as a result of the almost perfect combustion that takes place, there is virtually no creosote build-up in the chimney, thus greatly reducing chimney fire hazards and at the same time reducing chimney maintenance. Furthermore, peak performance can be obtained even with the use of soft and unseasoned wood and burn time can be increased because it is possible to slow the fire down and still maintain almost perfect combustion while transferring heat temperatures necessary for maximum comfort.

The present invention is also directed to the use of catalytic converters in wood stoves, and is particularly directed to an improved baffle system used in connection therewith. More specifically, as suggested in the aforesaid co-pending Albertsen application, it is desired to have all of the combustion gases pass through the catalytic converter when the stove is in its normal operating mode. However, since the catalytic converter is in the nature of a filter which to some degree resists or impedes the flow of combustion gases therethrough, it will be apparent that when the access door of the stove is opened, the combustion gases and smoke would follow the path of least resistance and would billow outwardly through the open access door. In order to prevent this, the co-pending Albertsen application discloses damper means which, when the access door of the stove is opened, automatically move by gravity to a position permitting direct access to the exhaust duct or flue of the stove, so that the combustion gases and smoke will be exhausted through the flue, rather than spilling into the room through the open access door.

The present invention achieves these same basic objectives by an improved damper system. Specifically, the damper of the present invention is manually controlled, rather than gravity controlled, thus eliminating the possibility of the damper inadvertently jamming or sticking in closed position when the access door of the stove is opened. In order to insure that the damper moves to its proper position when the access door of the stove is opened, handle means for manually manipulating the damper from outside the stove are provided, said handle means physically preventing the access door of the stove from opening until said handle means is moved to a predetermined position, said predetermined position regulating the damper so that flow of the combustion gases through the converter is blocked, and direct flow of the combustion gases to the stove exhaust is opened. Thus, in the present invention, the access door of the stove cannot be opened until the damper has positively been moved to its proper position.

In addition, with the stove in its normal operating mode, i.e. with the door of the stove closed and with combustion gases passing through the catalytic converter, the possibility exists that the catalytic converter may on occasion become blocked or clogged, primarily due to the burning of improper materials in the stove. Should this happen, there would be no place for the combustion gases and smoke to go, and hence said gases and smoke would force themselves out through the front opening of the stove, notwithstanding the fact that the access door is in closed position. This, of course, would result in undesirable smoke spillage into the room in which the stove is located. In order to prevent this, the damper of the present invention has been specifically designed with a controlled leakage factor, i.e. controlled leakage through the damper to the exhaust duct is possible, even when the damper is closing off the access opening to said duct. As a result of this built-in controlled leakage, should the catalytic converter become blocked or clogged, combustion gases and smoke still can pass through the closed damper to the exhaust duct, rather than spilling into the room around the door of the stove. This is an important feature of the present invention.

In addition, the damper system of the present invention permits the stove to assume an operational mode where coal can be burned instead of wood. This is not possible in the aforesaid co-pending Albertsen application.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
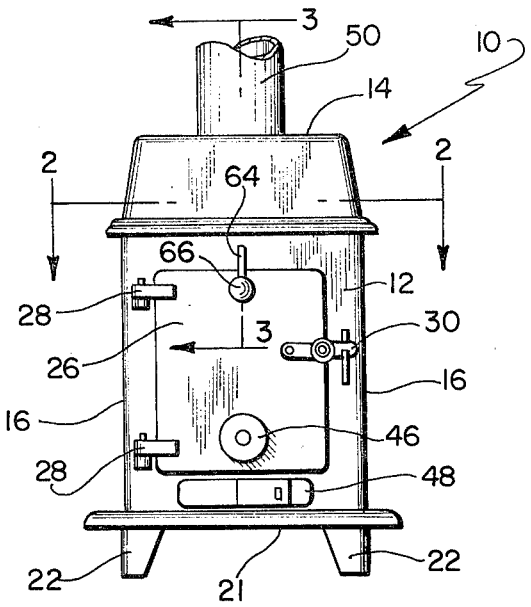
FIG. 1 is a front elevational view of one form of stove embodying the present invention.

Referring now to the drawings, and more particularly to FIG. 1, there is shown generally at 10 a stove comprising a front wall 12, top wall 14, side walls 16, rear wall 18 and bottom wall 20 defining a generally complete enclosure. The stove 10 may be fabricated from any suitable sheet metal or may be of cast iron. A plurality of supporting legs 22 depend from the bottom wall 20, as is conventional.

The front wall 12 of the stove is provided with an access opening 24 covered by a door 26 hingedly mounted as at 28 whereby the door may be swung to an open position when it is desired to gain access to the stove interior for any reason. A conventional handle and latch assembly 30 is provided to facilitate opening movement of the door and to maintain the door latched in its closed position.

A horizontal partition 32 located in spaced substantially parallel relation to top wall 14 but generally adjacent thereto defines a pair of interior chambers, namely, a relatively large primary combustion chamber 34 located below the partition and a relatively small afterburn chamber 36 located above the partition. As will be seen most clearly in FIG. 3, partition 32 is provided with a pair of circular openings 38 and 40. In addition, partition 32 has mounted thereon a catalytic converter 42, the details of which form no part of the instant invention, although it will be understood that converter 42 generally comprises a ceramic honeycomb having a thin metallic coating that acts as a catalyst to combustion gases. Specifically, the catalytic effect reduces the normally high ignition point of escaping combustion gases from their normal high range of approximately 1300° F. to a catalyzed average range of approximately 500° F., thus allowing for substantially complete burning of these gases, since the normal operating temperatures of wood burning stoves is in the range of 500° to 900° F. As will be noted, the converter 42 completely covers opening 38 whereby all combustion gases passing upwardly through the opening 38 must pass through converter 42. A viewing port 44 is provided in top wall 14 in registry with the converter 42 whereby the radiant state of the catalytic converter may be visually evaluated in order to permit draft controls 46, 48 communicating with chamber 34 to be adjusted for maximum operating efficiency of the stove. An exhaust duct or flue 50 communicates with afterburn chamber 36.

Figure 2:
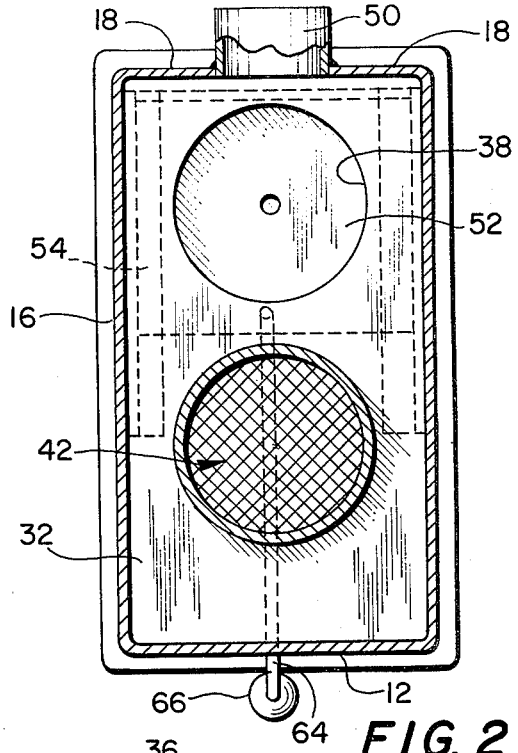
FIG. 2 is an enlarged section on line 2—2 of FIG. 1.
Figure 3:
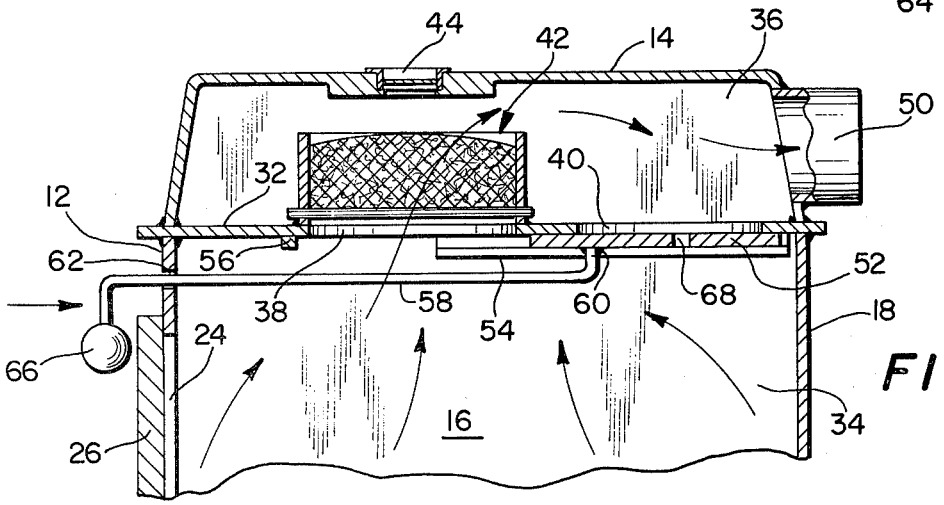
FIG. 3 is an enlarged fragmentary section on line 3—3 of FIG. 1 showing the stove in its normal operational mode.
Figure 4:
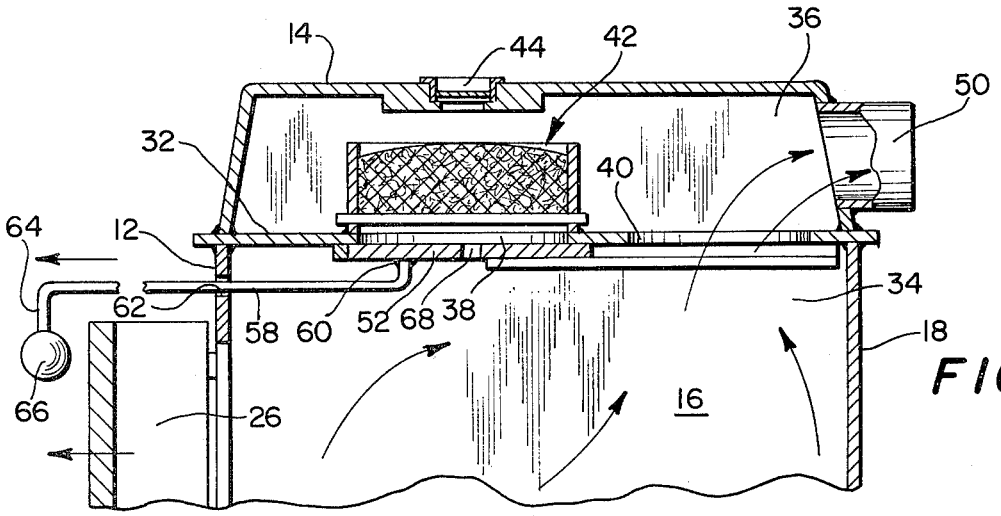
FIG. 4 is a view similar to FIG. 3 but showing the damper in the position it assumes when the door of the stove is opened.
Figure 6:
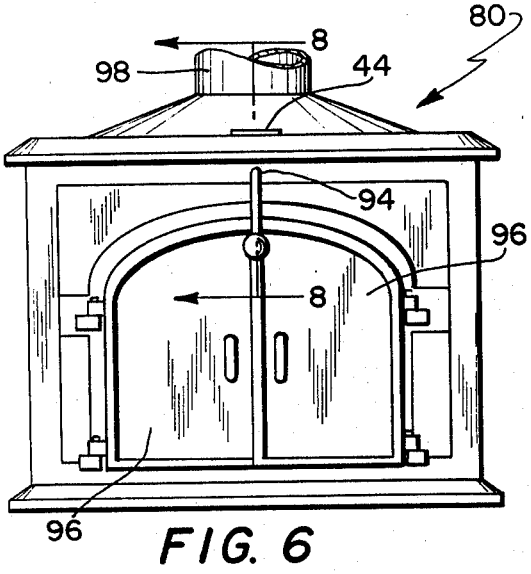
FIG. 6 is a front elevational view of a fireplace insert type stove embodying the present invention.
Figure 7:
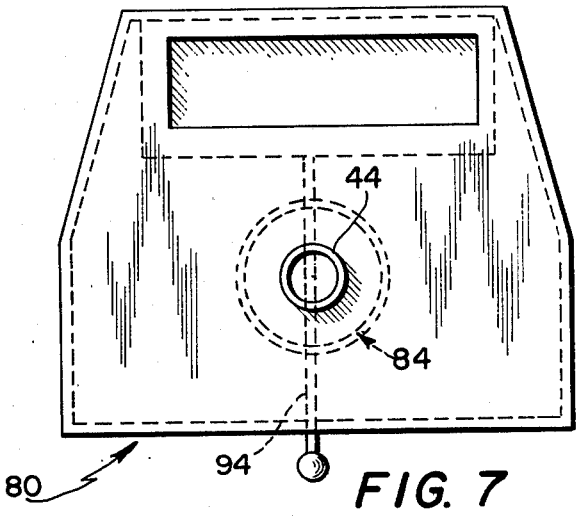
FIG. 7 is a top plan view thereof.
Figure 8:
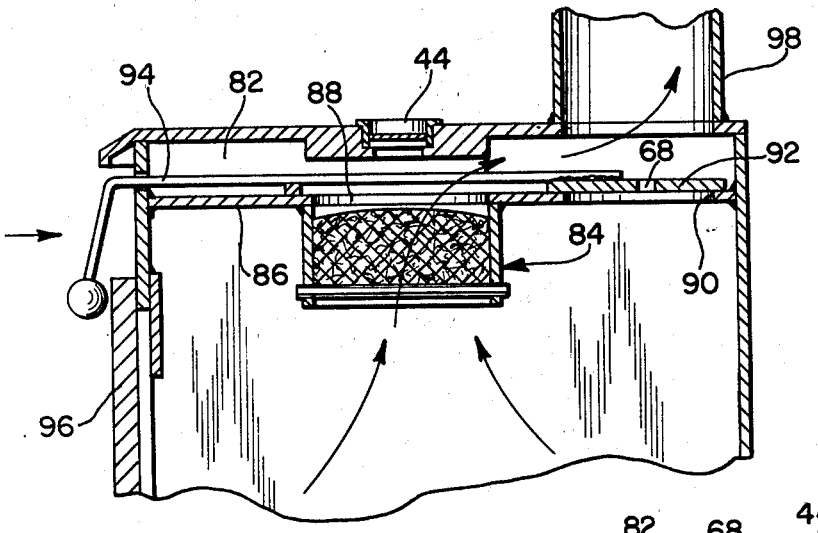
FIG. 8 is an enlarged fragmentary section taken on line 8—8 of FIG. 6.
Figure 9:
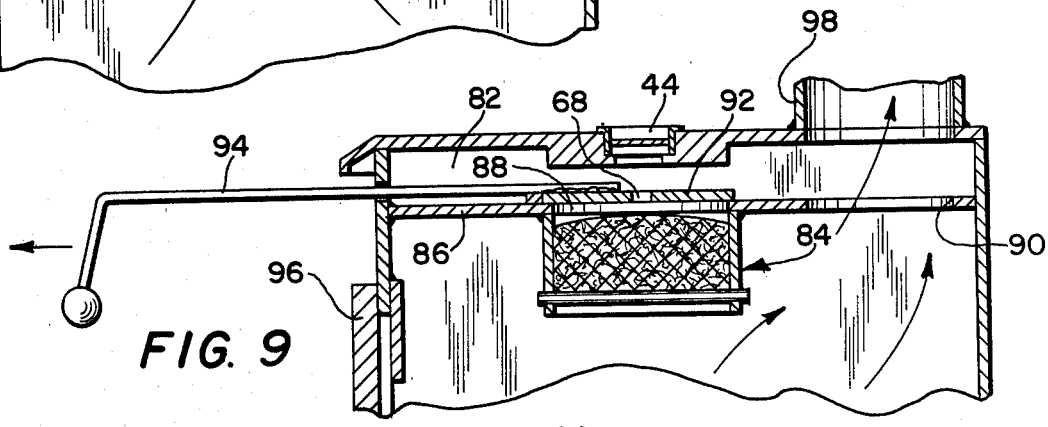
FIG. 9 is a view similar to FIG. 8 but showing the position of the damper when the door is free to be opened.

Referring to FIGS. 2 through 4, it will be seen that damper means in the form of plate 52 is slidably mounted on the underside of partition 32. Specifically, a pair of trackways 54 are secured to the inner surface of side wall 16 for sidably supporting damper 52 whereby the latter may be moved between a first position in which it covers opening 40, as illustrated in FIG. 3, and a second position wherein it covers opening 38 and unblocks opening 40, as illustrated in FIG. 4. Stop means in the form of a small abutment 56 is secured to the underside of partition 32 to limit the travel of damper 52 and to insure that when the damper 52 has been moved to the position illustrated in FIG. 4, it will be in proper registry with opening 38 so as to cover same. Movement of damper 52 between the positions illustrated in FIGS. 3 and 4 is manually achieved by means of an elongated rod 58 secured at its inner end as at 60 to damper 52 and extending outwardly through opening 62 provided in front wall 12 just above the top of door 26. At its outermost extremity, the rod 58 has a downwardly bent portion 64 terminating in a knob or handle 66. As will be clearly seen in FIG. 3, when damper 52 is in its innermost position, i.e. covering the opening 40, the downwardly bent portion 64 and knob 66 physically block opening movement of door 26. Thus, before the door 26 can be opened, rod 58 must be retracted to the position illustrated in FIG. 4, whereupon opening 40 becomes unblocked, and opening 38 becomes blocked. For reasons which will hereinafter become apparent, damper 52 is provided with a relatively small aperture or opening 68.

The operation of stove 10 is as follows. With the rod 58 in the retracted position illustrated in FIG. 4, the door 26 is free to open to permit loading of the stove with a supply of wood. After the wood has been set on fire, the door 26 is closed, but the rod 58 is retained in the retracted position illustrated in FIG. 4 so that for a period of time the opening 40 remains unobstructed. This facilitates starting of the fire by increasing the draft, it being understood that when the damper is in the position illustrated in FIG. 3, the draft is reduced due to the inherent resistance of converter 42 through which the combustion gases must flow. Accordingly, in order to increase the draft when the fire in the stove is being started, the damper is retained in the FIG. 4 position for a period of time, or until the fire has really taken hold. At the same time, the draft controls 46 and 48 are regulated to achieve the desired air intake into combustion chamber 34 to initiate and maintain proper burning therein. Once the fire in combustion chamber 34 is going strongly, the rod 58 is moved inwardly to the position illustrated in FIG. 3, wherein damper 52 now covers or blocks opening 40, whereby the flow of combustion gases to afterburn chamber 36 is necessarily through the catalytic converter 42. As previously explained, the converter 42 reduces the ignition point of the combustion gases passing therethrough so that almost complete combustion of the latter takes place, thereby eliminating the passage of smoke to exhaust duct 50 whereby resulting pollution is almost completely eliminated. Also, due to the almost complete burning of the combustion gases prior to entering the flue or exhaust duct 50, there is virtually no creosote build-up in the flue or associated chimney, thus greatly reducing chimney fire hazards and reducing maintenance. If, however, the door 26 of the stove could be opened with the damper in the position illustrated in FIG. 3, the smoke and combustion gases in chamber 34 would follow the path of least resistance and would billow outwardly through the opened door. In order to prevent this from happening, door 26 cannot be opened until rod 58 has been retracted to the position illustrated in FIG. 4, in which position the downwardly bent end portion 64 and handle or knob 66 no longer obstructs opening of the door. As will be apparent, when rod 58 is moved to this position, the damper 52 automatically moves to a position wherein it blocks converter 42 and unblocks opening 40, whereupon smoke and combustion gases from combustion chamber 34 will pass through opening 40 to exhaust duct or flue 50 rather than flowing out the front of the stove.

On some occasions the catalytic converter 42 may become blocked or clogged primarily due the burning of improper materials in the stove. Should this happen while the stove is in its normal operating mode, i.e. as illustrated in FIG. 3, there would normally be no place for the combustion gases and smoke to go and hence said gases and smoke would force their way out around the closed door 26, thus resulting in undesirable smoke spillage into the room in which the stove is located. In order to prevent this from happening, an important feature of the present invention is the provision of means permitting controlled leakage of combustion gases and smoke through opening 40, even when damper 52 is in the position illustrated in FIG. 3. The controlled leakage means may take the form of a relatively small opening, such as the opening 68 in damper 52, whereupon when the damper is in the position illustrated in FIG. 3, the flow of combustion gases will still be through converter 42 since this path offers less resistance than the relatively small aperture 68, but on the other hand, should the converter 42 become blocked or clogged, the aperture 68 does provide a path through which the combustion gases and smoke may pass to duct 50, rather than being forced out through the front of the stove. It will be understood that the leakage means need not necessarily take the form of aperture 68, but rather the desired leakage could also be achieved by having a loose or sloppy seal between damper 52 and partition 32 when the former is in the position illustrated in FIG. 3.

If it is desired to burn coal in stove 10, the catalytic converter must be bypassed because the sulfur in the coal fumes would be detrimental to the converter and would destroy same. Thus, when coal is being burned, the damper 52 is moved to the position illustrated in FIG. 4 to substantially block access to the catalytic converter, whereupon the combustion gases and fumes from the burning coal would pass directly through opening 40 to exhaust duct 50. Of course, the door 26 would be maintained in closed position, even though the rod 58 remains in the retracted position of FIG. 4.

Figure 5:
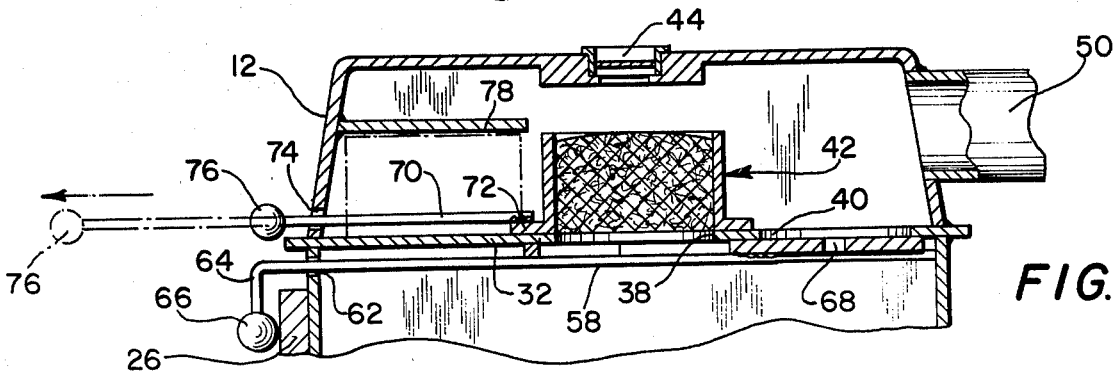
FIG. 5 is a fragmentary sectional view of a slightly modified construction.

FIG. 5 illustrates a modification to the stove shown in FIGS. 1 through 4, which modification is specifically designed to improve operation of the stove when burning coal. Specifically, in the form of the invention illustrated in FIG. 5, the catalytic converter 42 is slidably mounted on partition 32 for movement from the full line position illustrated to the broken line position. Specifically, a rod 70 is secured at its inner end to converter 42, as at 72, said rod extending through an opening 74 in front wall 12, it being noted that the opening 74 is located slightly above the opening 62. Rod 70 terminates at its outer extremity in a handle or knob 76 whereupon manipulation of rod 70 from the full line to broken line position thereof causes corresponding movement of converter 42 from its full line to its broken line position. A substantially horizontally extending plate 78 is secured to and extends from front wall 12 whereupon when converter 42 has been moved to its inoperative or broken line position, as illustrated in FIG. 5, the plate 78 functions to define a cover for the top of the converter, whereupon the converter is protected both at its top and bottom from exposure to coal fumes in the stove, it being understood that the only time converter 42 is moved to its inoperative or broken line position, as illustrated in FIG. 5, is when stove 10 is being used to burn coal. Of course, in the embodiment illustrated in FIG. 5, it is not necessary to retract the rod 58 when burning coal, because opening 38 becomes completely unobstructed when converter 42 is moved to its broken line position, and hence provides the necessary communication with chamber 36.

FIGS. 6 through 9 illustrate application of the present invention to a fireplace insert stove shown generally at 80. Aside from obvious cosmetic differences, the only real difference between stove 10 and stove 80 is that the latter has a much more shallow afterburn chamber 82 thus necessitating that the catalytic converter 84 be mounted on the underside of horizontal partition 86, as illustrated most clearly in FIGS. 8 and 9. Opening 88, in registry with the converter 84, and opening 90 in partition 86 correspond to the aforedescribed openings 38, 40 respectively. Damper 92 and manipulating rod 94 correspond with and operate in an identical manner to aforesaid damper 52 and rod 58. As stated, the only real difference from a functional standpoint between stoves 80 and 10 is that because of the relatively shallow afterburn chamber 82 in the former, the catalytic converter depends from the horizontal partition member, rather than being located on the top side thereof. By the same token, in this form of the invention, the damper means slides along the top surface of the partition, rather than along the underside thereof, as in stove 10. Doors 96 in the stove 80 cannot be swung to open position until rod 94 has been retracted to the position illustrated in FIG. 9, at which point the passage of combustion gases and smoke through the catalytic converter is blocked by damper 92, thus causing the combustion gases and smoke to flow through opening 90 to exhaust duct 98 whenever the doors 96 are opened. The one disadvantage of the stove illustrated in FIGS. 6 through 9 is that it cannot be used to burn coal, since the exposure of the catalytic converter 84 to the coal fumes would quickly destroy the converter.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A stove comprising front, rear, top, bottom and side walls, a door on said front wall movable between a closed and open position to permit access to the stove interior, a substantially horizontal partition in said stove located in spaced relation to but adjacent said top wall defining a relatively large combustion chamber therebelow and a relatively small afterburn chamber thereabove, an exhaust duct communicating with said afterburn chamber and draft means communicating with said combustion chamber, said partition having two openings therein, a catalytic converter mounted on said partition in registry with one of said openings whereby all gases passing through said one opening pass through said converter, damper means movable between a first position wherein said one opening is unobstructed and said other opening is substantially blocked, and a second position wherein said other opening is unobstructed and said one opening is substantially blocked, and handle means operable from outside the stove to move said damper between said first and second positions, said handle means blocking opening movement of said door when said damper is in its said first position, whereby said door can be opened only when said damper has been moved to its said second position.

2. In the stove of claim 1, said damper means permitting controlled leakage of combustion gases through said other opening when said damper is in its said first position, whereby if said catalytic converter becomes clogged, combustion gases still can pass through said other opening to said exhaust duct.

3. In the stove of claim 2, said damper means having a relatively small opening therethrough to effect said controlled leakage.

4. In the stove of claim 1, said door being hingedly mounted on said front wall for pivotal movement to said open position, said handle means comprising an elongated rod secured at its inner end to said damper, the outer end of said rod extending slidably through said front wall and having a bent outer end portion extending over an edge of said door to prevent opening movement thereof when said damper is in said first position, whereby in order to permit opening of said door, said rod must be retracted from said stove, thereby moving said damper to its said second position.

5. In the stove of claim 1, said catalytic converter being positioned in said afterburn chamber and being movable from its operative position in registry with said one opening to a non-operative position displaced therefrom, and a horizontal plate mounted in said afterburn chamber intermediate said partition and said stove top wall, said horizontal plate covering the top of said converter when the latter has been moved to its non-operative position.

6. In the stove of claim 5, means for moving said converter between its operative and non-operative positions, said means comprising a rod connected at its inner end to said converter, said rod extending slidably through an opening in said stove front wall for manipulation from outside the stove.

7. In the stove of claim 5, said damper means permitting controlled leakage of combustion gases through said other opening when said damper is in its said first position, whereby if said catalytic converter becomes clogged, combustion gases still can pass through said other opening to said exhaust duct.

8. In the stove of claim 1, said catalytic converter being secured to the underside of said partition and extending into said combustion chamber.

* * * * *